US007636069B2

(12) United States Patent
Wong et al.

(10) Patent No.: US 7,636,069 B2
(45) Date of Patent: Dec. 22, 2009

(54) BROADBAND DIPOLE ANTENNA

(75) Inventors: Kin-Lu Wong, Kao-Hsiung (TW); Yu-Chan Yang, Taipei (TW); Wei-Yu Li, Yilan County (TW); Saou-Wen Su, Taipei (TW); Jui-Hung Chou, Tai-Chung (TW)

(73) Assignees: Lite On Technology Corp., Taipei (TW); National Sun Yat-Sen University, Kao-Hsiung (TW)

( * ) Notice: Subject to any disclaimer, the term of this patent is extended or adjusted under 35 U.S.C. 154(b) by 186 days.

(21) Appl. No.: 11/829,092

(22) Filed: Jul. 27, 2007

(65) Prior Publication Data

US 2009/0027291 A1 Jan. 29, 2009

(51) Int. Cl.
*H01Q 9/28* (2006.01)

(52) U.S. Cl. ..... 343/795; 343/803

(58) Field of Classification Search ..... 343/792.5, 343/795, 802, 807, 803
See application file for complete search history.

(56) References Cited

U.S. PATENT DOCUMENTS

| | | | | |
|---|---|---|---|---|
| 2,908,000 | A * | 10/1959 | Robinson, Jr. | 343/746 |
| 2,973,517 | A * | 2/1961 | Watts, Jr. | 343/795 |
| 3,092,835 | A * | 6/1963 | Jaytanie | 343/802 |
| 4,835,542 | A * | 5/1989 | Sikina, Jr. | 343/802 |
| 6,650,301 | B1 * | 11/2003 | Zimmerman | 343/803 |

FOREIGN PATENT DOCUMENTS

| | | |
|---|---|---|
| TW | M261844 | 4/2005 |
| TW | D105579 | 7/2005 |

* cited by examiner

*Primary Examiner*—Tho G Phan
(74) *Attorney, Agent, or Firm*—Rosenberg, Klein & Lee

(57) ABSTRACT

A broadband dipole antenna includes a dielectric substrate, a first radiating portion, a second radiating portion, a substantially U-shaped or V-shaped feed gap, and two feed points. The feed gap is located in-between the first radiating portion and the second radiating portion. The two feed points are located in the first radiating portion and the second radiating portion, respectively, and separated by the feed gap.

5 Claims, 8 Drawing Sheets

BROADBAND DIPOLE ANTENNA

BACKGROUND OF THE INVENTION

1. Field of the Invention

The present invention relates to a broadband antenna, and more particularly, to a broadband dipole antenna for digital TV.

2. Description of the Prior Art

In this era of information explosion, people are used to turning on the TV to receive the latest information and entertainment. The TV has influenced people from home to everywhere in life, whether as large as the outdoor TV, or as small as the portable multimedia players or car TV. The TV is almost in anywhere.

TV signals have traditionally been transmitted through analog signals, but the analog signals are susceptible to noise, resulting in the instability and distortion. In contrast, the government and manufacturers are popularizing the digital TV system. The digital TV system provides not only better stability of signals and quality of images, but also multimedia services. Thus, the inevitably tendency is that the digital TV system will replace the analog TV system. In recent years, as people gradually have more time to spend on leisure and outdoor activities, use of the digital TV for the car is additionally constantly rising. Improving the quality of the video and audio of the digital TV for the car is required, so how to design an antenna with a simple structure suitable for the car has become a challenge worth the effort.

The R.O.C. patent number M261844 "Car Antenna for the Digital TV" shows a digital TV antenna, but the structure of the antenna is complicated. Furthermore, the size of the antenna is large, as shown in R.O.C. patent number D105579 "Digital TV Antenna". The large antenna cannot be hidden in the window of the car or located in the corner inside the car, so the antenna may deface the car and decrease the desirability of the TV. To solve the mentioned problems, a new digital TV receiving antenna, which can generate a broad bandwidth covering the complete spectrum of digital TV channels (470-862 MHz) and has a simple structure so as to fit the car, should be provided.

SUMMARY OF THE INVENTION

It is therefore an objective of the claimed invention to provide a broadband dipole antenna capable of generating a lower resonant mode (at about 550 MHz) from a first radiating portion and a second radiating portion, and generating an upper resonant mode (at about 750 MHz) from adjusting a substantially U-shaped or V-shaped feed gap between the first radiating portion and the second radiating portion. Thus, the broadband dipole antenna is capable of generating a broad bandwidth so as to cover the complete spectrum of digital TV channels (470-862 MHz). In addition, the feed gap can balance the radiation field so that the antenna has similar radiation fields in the spectrum of digital TV channels.

The claimed invention provides a broadband dipole antenna comprising a dielectric substrate; a first radiating portion located on the dielectric substrate; a second radiating portion located on the dielectric substrate, forming a V shape with the first radiating portion, the V shape having a flare angle between 30 and 180 degrees; a feed gap, which is a substantially V shape or U shape, located in-between the first radiating portion and the second radiating portion; and two feed points, separated by the feed gap, located on the first radiating portion and the second radiating portion, respectively.

The claimed invention further provides a broadband dipole antenna comprising a dielectric substrate; a first radiating portion, located on the dielectric substrate; a second radiating portion, located on the dielectric substrate, extended in the reverse direction of the first radiating portion and forming a rectangular shape with the first radiating portion; a feed gap, located in-between the first radiating portion and the second radiating portion, which is substantially a V shape or U shape; and two feed points, separated by the feed gap, located on the first radiating portion and the second radiating portion, respectively.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
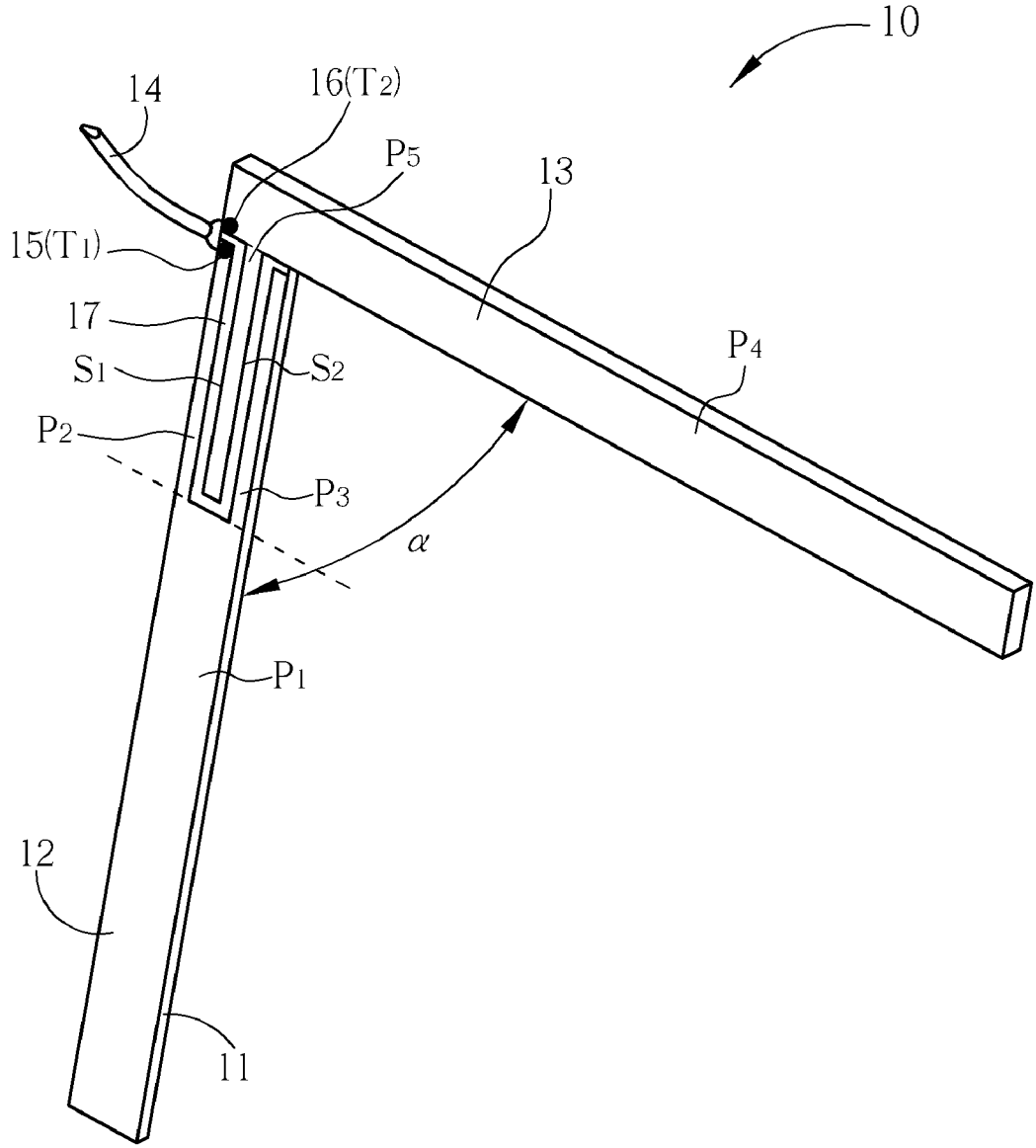
FIG. 1 is a view of a first embodiment of a broadband dipole antenna according to the present invention.

Please refer to FIG. 1. FIG. 1 is a first embodiment of a broadband dipole antenna according to the present invention. The broadband dipole antenna 10 comprises a dielectric substrate 11, a first radiating portion 12 located on the dielectric substrate 11, and a second radiating portion 13 located on the dielectric substrate 11. The second radiating portion 13 and the first radiating portion 12 form a V shape. The flare angle of the V shape is between 30 and 180 degrees. In this embodiment, the flare angle $\alpha$ of the Y shape is 90 degrees. A metal layer (not labeled) is disposed on the dielectric substrate 11. The first radiating portion 12 and the second radiating portion 13 are formed by printing or etching on the dielectric substrate 11. The first radiating portion 12 and the second radiating portion 13 have a feed gap 17 there between. The feed gap 17 is formed on the dielectric substrate 11 by etching the metal layer in a way similar to the first and second radiating portion 12 and 13. The width of the feed gap 17 is smaller than 5 mm. The shape of the feed gap 17 is substantially a U shape. The first radiating portion 12 comprises three parts $P_1$, $P_2$, $P_3$ and a first terminal $T_1$. The second radiating portion 13 comprises two parts $P_4$, $P_5$ and a second terminal $T_2$. The parts $P_2$ and $P_3$ are both connected to the part $P_1$. The part $P_5$ is connected to the part $P_4$. The feed gap 17 is surrounded by the parts $P_1$, $P_2$, $P_3$, and the part $P_5$ is surrounded by the feed gap 17. Also, the part $P_2$ and $P_3$ are coupled to the first side $S_1$ and the second side $S_2$ of the part $P_5$ respectively through the feed gap 17, wherein the first side $S_1$ and the second side $S_2$ of the part $P_5$ are opposite to each other as illustrated in FIG. 1. The first radiation portion 12 and the second radiation portion 13 are separated by the feed gap 17. The first terminal $T_1$ and the second terminal $T_2$ are disposed at the part $P_2$ of the first radiating portion 12 and the part $P_4$ of the second radiating portion 13 respectively. Both of the first terminal $T_1$ and the second terminal $T_2$ are adjacent to the feed gap 17 and the coaxial cable 14. The feed point 15 is located at the first terminal $T_1$ and the feed point 16 is located at the second terminal $T_2$. The feed point 15 of the first radiating portion 12 and the feed point 16 of the second radiating portion 13 are separated by the feed gap 17. The feed point 15 and the feed point 16 are electrically connected to a central conductor and a grounding sheath of a coaxial cable 14, respectively.

Figure 2:
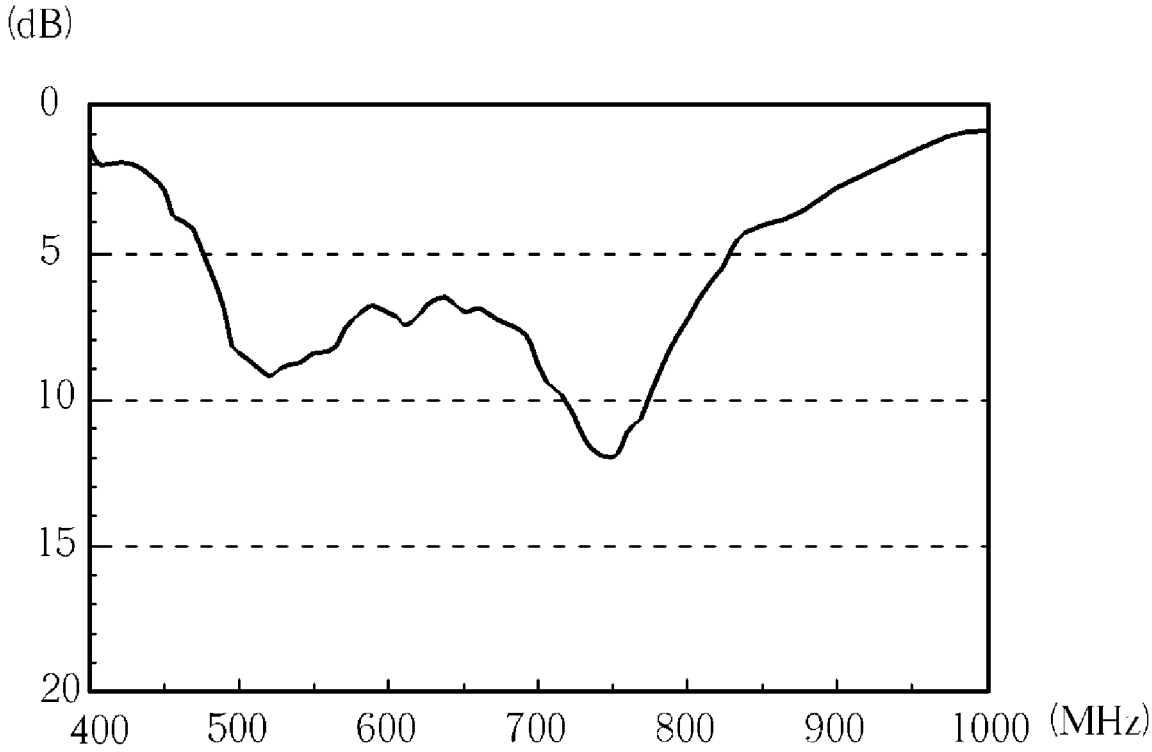
FIG. 2 is a diagram of the return loss of the broadband dipole antenna according to the present invention.

Please refer to FIG. 2. FIG. 2 is a diagram of the return loss of the broadband dipole antenna according to the present invention. In this embodiment, the size of the broadband dipole antenna 10 is as follows. The first radiating portion 12 and the second radiating portion 13 are 130 mm in length and 10 mm in width, respectively. The flare angle α of the dielectric substrate 11 is 90 degrees. The feed gap 17 is substantially a U shape located inbetween the first radiating portion 12 and the second radiating portion 13. The width of the feed gap is 1 mm. As shown in FIG. 2, the y-coordinate axis is return loss, and the x-coordinate axis is frequency. From the data, the return loss of the antenna 10 in the digital TV bandwidth 470-862 MHz is higher than 5 dB. Thus, the return loss of the antenna 10 can satisfy the requirement of the digital TV system in practice.

Figure 3:
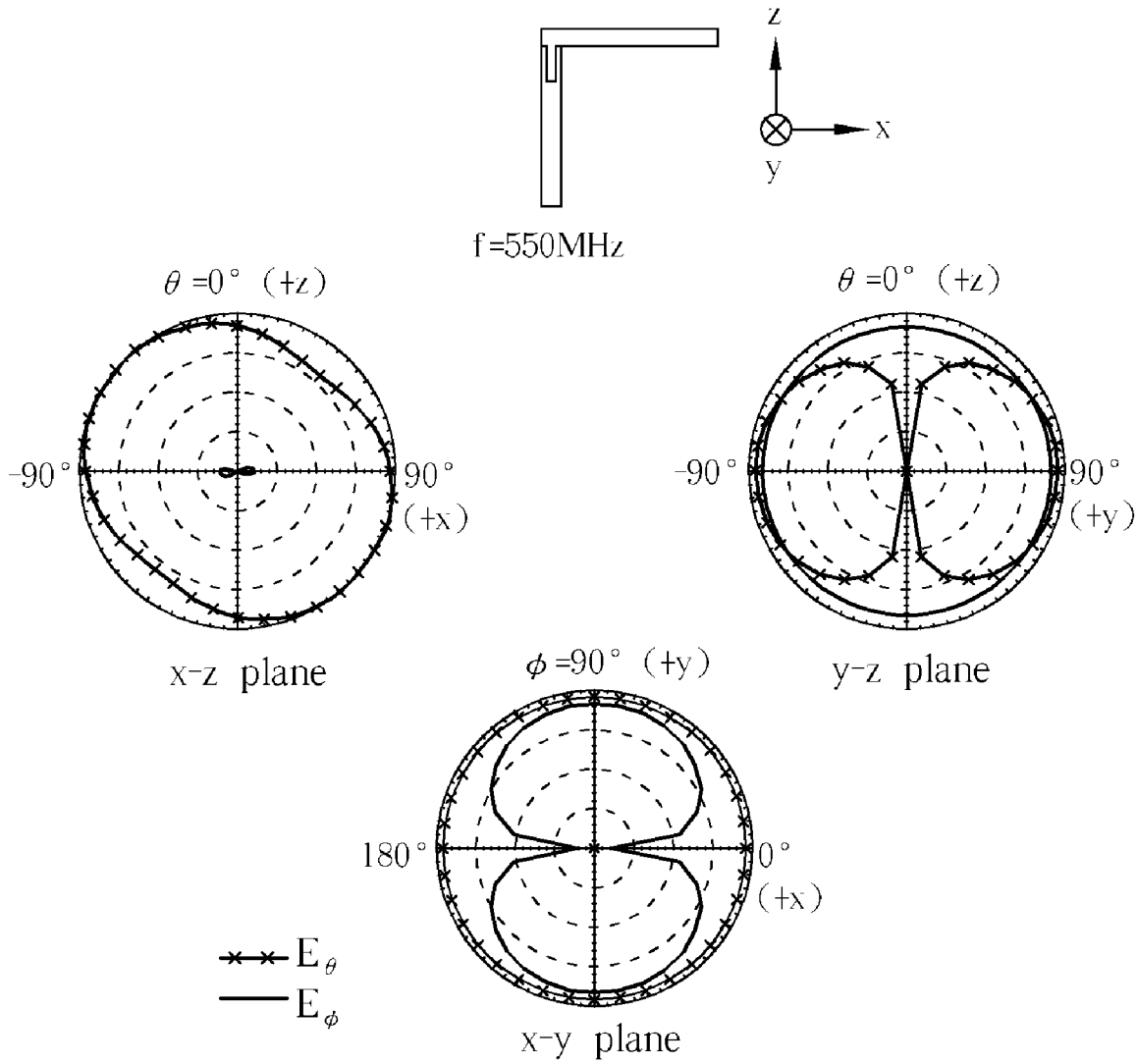
FIG. 3 is the radiation pattern at 550 MHz of the broadband dipole antenna according to the present invention.
Figure 4:
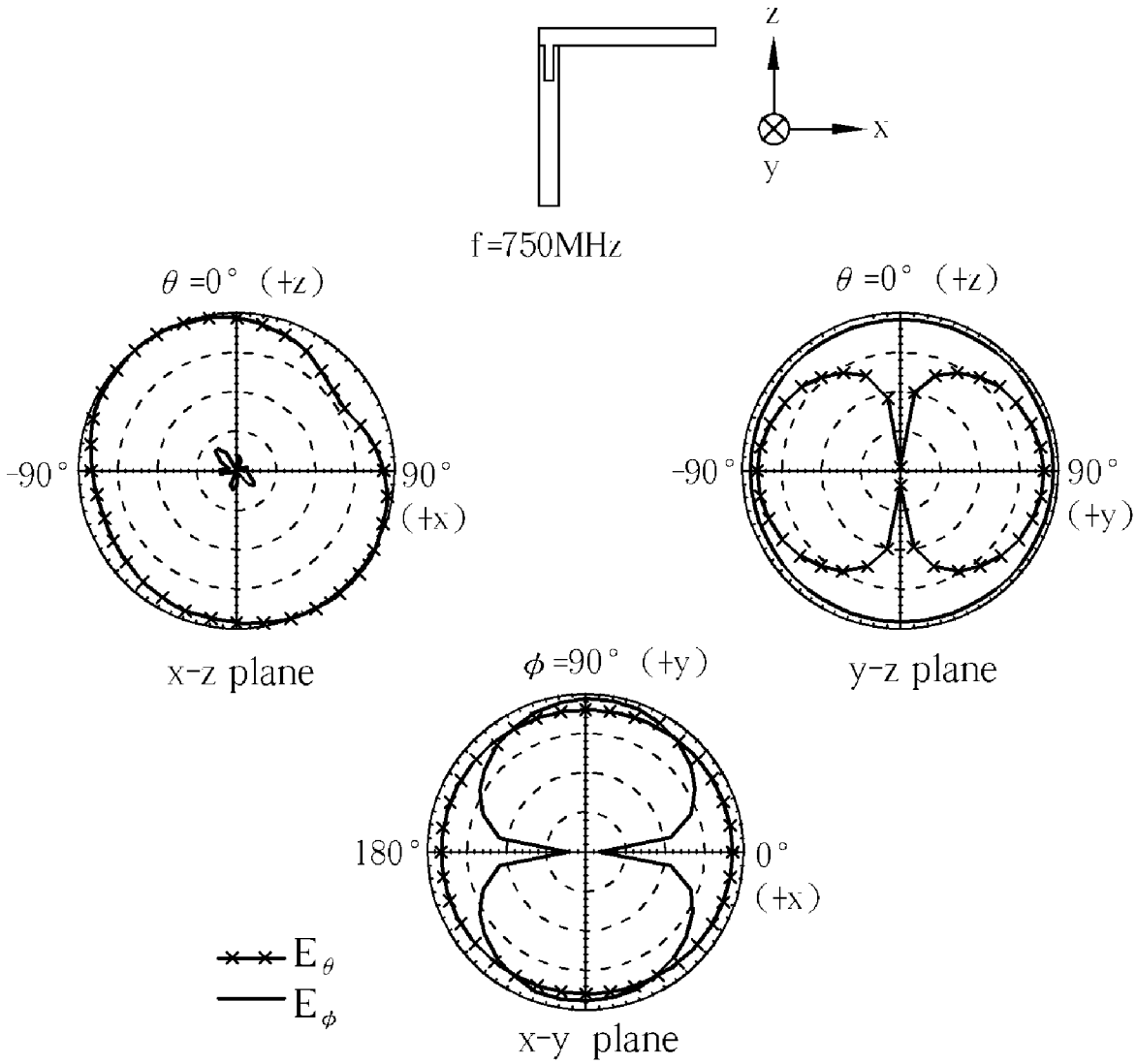
FIG. 4 is the radiation pattern at 750 MHz of the broadband dipole antenna according to the present invention.

Please refer to FIG. 3 and FIG. 4. FIG. 3 is the radiation pattern at 550 MHz of the broadband dipole antenna according to the present invention. FIG. 4 is the radiation pattern at 750 MHz of the broadband dipole antenna according to the present invention. From the measurement result, the antenna 10 has similar radiation fields in 550 MHz and 750 MHz. Thus, the antenna 10 has similar radiation fields in the spectrum of digital TV channels.

Figure 5:
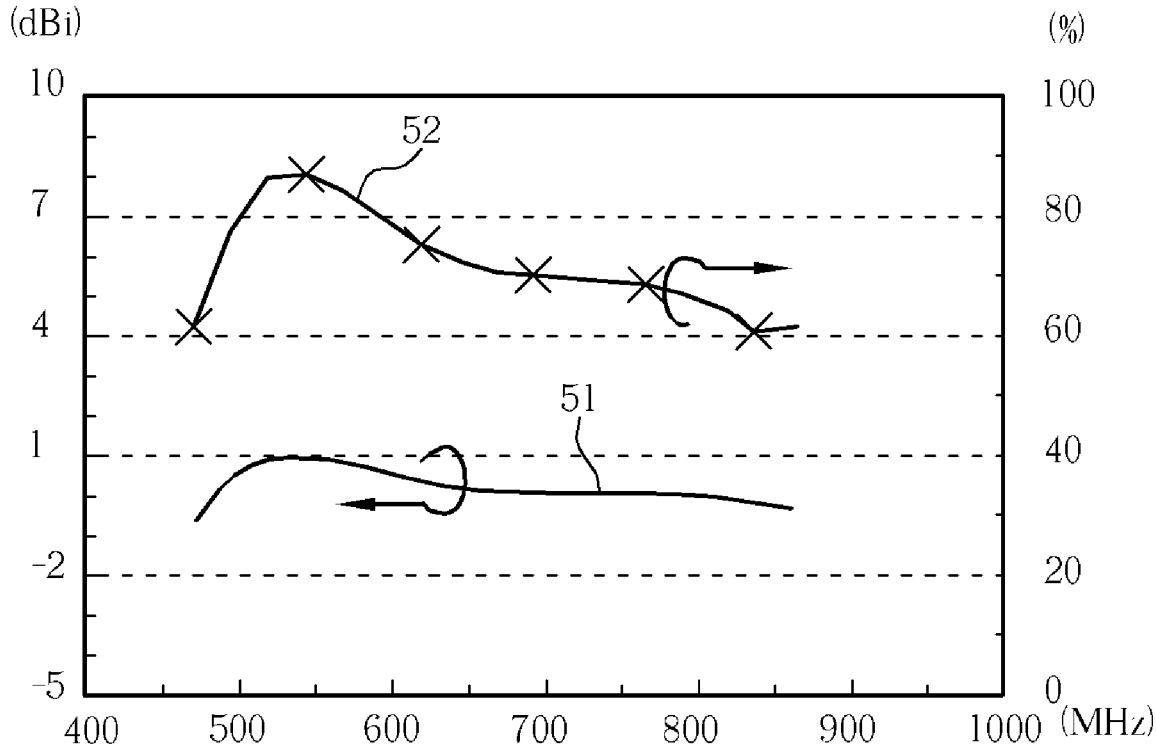
FIG. 5 is a diagram of the antenna gain and radiation efficiency in the operational bandwidth of the broadband dipole antenna according to the present invention.

Please refer to FIG. 5. FIG. 5 is a diagram of the antenna gain 51 and the radiating efficiency 52 in the operational bandwidth of the broadband dipole antenna according to the present invention. As shown in FIG. 5, the right y-coordinate axis is radiation efficiency; the left y-coordinate axis is antenna gain; the x-coordinate axis is frequency. From the measurement result, in the digital TV bandwidth 470-862 MHz, the radiation efficiency 52 of the antenna 10 is higher than 60%, and the antenna gain 51 of the antenna 10 is larger than −1.5 dBi. Thus, the antenna 10 can satisfy the general requirement in practice.

Figure 6:
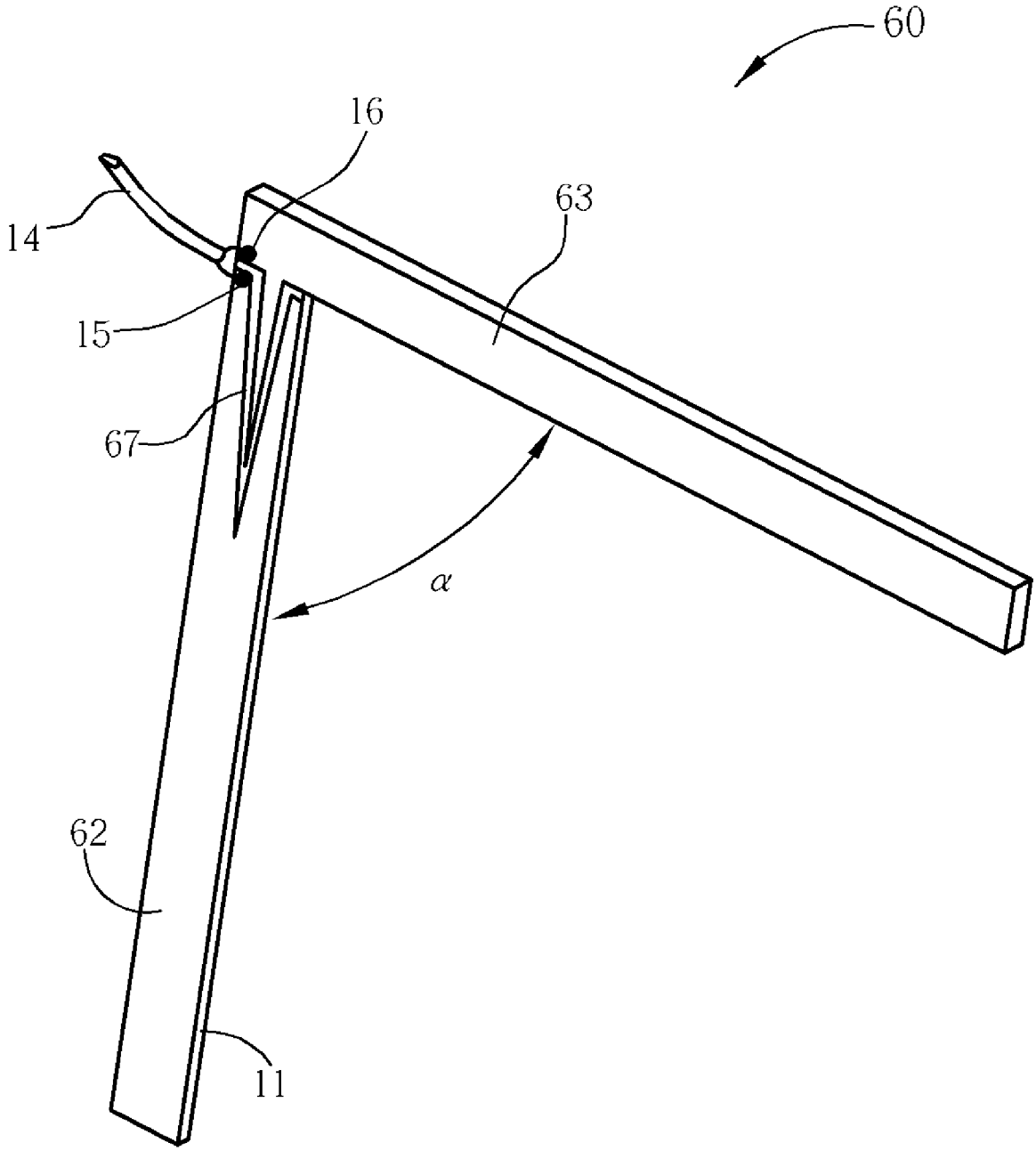
FIG. 6 is a view of a second embodiment of a broadband dipole antenna according to the present invention.

Please refer to FIG. 6. FIG. 6 is a second embodiment of a broadband dipole antenna according to the present invention. In the second embodiment, the broadband dipole antenna 60 comprises a feed gap 67. The feed gap 67 is substantially a V shape located in-between the first radiating portion 62 and the second radiating portion 63. The width of the feed gap 67 is 1 mm. In addition, the flare angle α of the dielectric substrate 11 is 90 degrees. The width and length of the first radiating portion 62 and the second radiating portion 63 are the same as the first embodiment. Thus, the broadband dipole antenna 60 in the second embodiment can satisfy the requirements of impendence, bandwidth, and radiation efficiency of the digital TV system (470-862 MHz).

Figure 7:
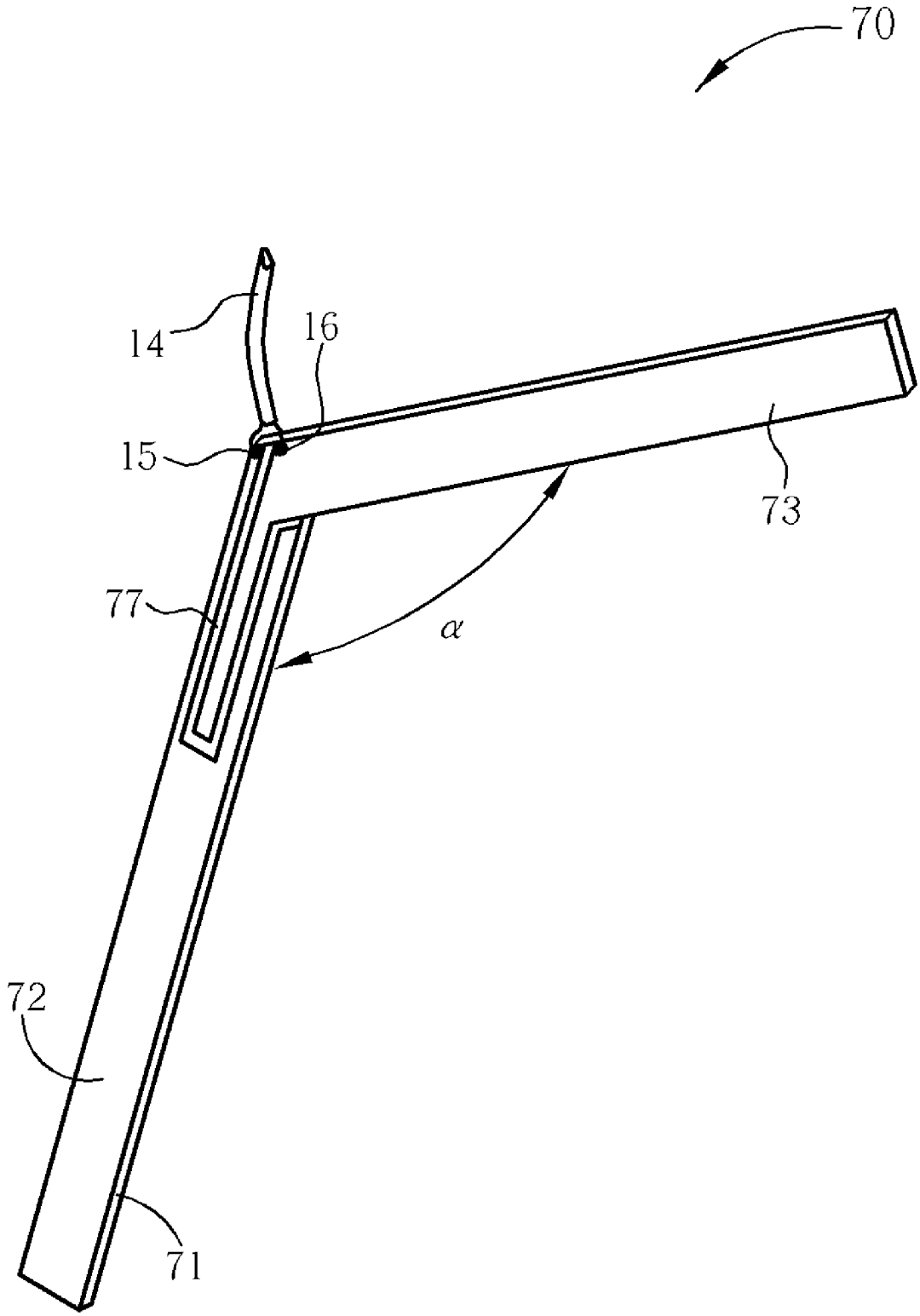
FIG. 7 is a view of a third embodiment of a broadband dipole antenna according to the present invention.

Please refer to FIG. 7. FIG. 7 is a third embodiment of a broadband dipole antenna according to the present invention. In the third embodiment, the broadband dipole antenna 70 comprises a dielectric substrate 71 having a flare angle α of 120 degrees, so a feed gap 77 has a shape fit for the flare angle of the dielectric substrate 71. In addition, the width and length of the first radiating portion 72 and the second radiating portion 73 are the same as the first embodiment. Thus, the broadband dipole antenna 70 in the third embodiment can satisfy the requirements of impendence, bandwidth, and radiation efficiency of the digital TV system (470-862 MHz).

Figure 8:
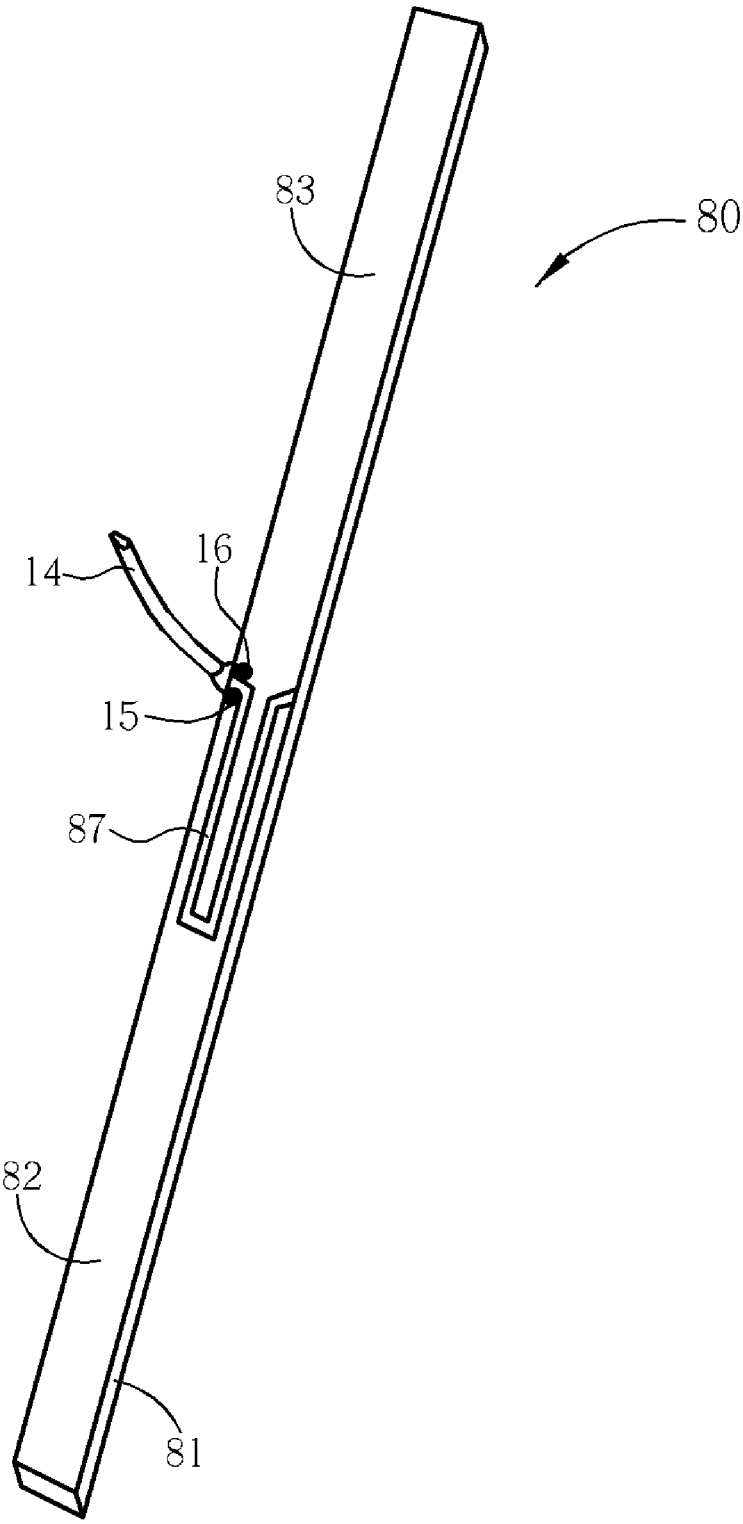
FIG. 8 is a view of a fourth embodiment of a broadband dipole antenna according to the present invention.

Please refer to FIG. 8. FIG. 8 is a fourth embodiment of a broadband dipole antenna according to the present invention. In the fourth embodiment, the broadband dipole antenna 80 comprises a dielectric substrate 81. The dielectric substrate 81 is substantially a rectangular shape. The length of the dielectric substrate 81 is 265 mm, and the width of the dielectric substrate 81 is 10 mm. In addition, the width and length of the first radiating portion 82 and the second radiating portion 83 are the same as the first embodiment. The width of the feed gap 87 between the first radiating portion 82 and the second radiating portion 83 is 1 mm. The shape of the feed gap 87 is substantially a U shape, or is substantially a V shape as shown in FIG. 2. Thus, the broadband dipole antenna 80 in the fourth embodiment can satisfy the requirements of impendence, bandwidth, and radiation efficiency of the digital TV system (470-862 MHz).

In conclusion, the broadband dipole antenna according to the present invention is capable of generating a lower resonant mode (at about 550 MHz) from the first radiating portion and the second radiating portion, and generating a upper resonant mode (at about 750 MHz) from adjusting the substantially U-shaped or V-shaped feed gap between the first radiating portion and the second radiating portion. Thus, the broadband dipole antenna according to the present invention is capable of generating a broad bandwidth to cover the complete spectrum of digital TV channels (470-862 MHz). In addition, the broadband dipole antenna according to the present invention has a simple structure for manufacturing and installing on the windowpane of the car, especially around the corner of the windowpane of the car.

Those skilled in the art will readily observe that numerous modifications and alterations of the device and method may be made while retaining the teachings of the invention.

What is claimed is:

1. A broadband dipole antenna comprising:

a dielectric substrate;

a metal layer, formed on the dielectric substrate;

a feed gap, which is substantially a V shape or U shape, formed on the dielectric substrate by etching the metal layer;

a first radiating portion, formed from the etched metal layer and located on the dielectric substrate, the first radiating portion comprising:

a first radiating part;

a second radiating part connected to the first radiating part; and a third radiating part connected to the first radiating part;

wherein the feed gap is surrounded by the first radiating part, the second radiating part and the third radiating part;

a second radiating portion, formed from the etched metal layer and located on the dielectric substrate, forming a substantial V shape with the first radiating portion, the V shape having a flare angle between 30 and 180 degrees, the second radiating portion comprising:

a fourth radiating part; and a fifth radiating part, connected to the fourth radiating part and surrounded by the feed gap;

a first feed point, located at a first terminal of the second radiating part of the first radiating portion;

wherein the first terminal of the second radiating part of the first radiating portion is adjacent to the feed gap; and a second feed point, located at a second terminal of the fourth radiating part of the second radiating portion;

wherein the second terminal of the fourth radiating part of the second radiating portion is adjacent to the feed gap;

wherein the first and the second feed points are separated by the feed gap.

2. The broadband dipole antenna of claim 1, wherein the two feed points are electrically connected to a central conductor and a grounding sheath of a coaxial cable respectively.

3. The broadband dipole antenna of claim 1, wherein the first radiating portion and the second radiating portion are formed by printing or etching on the dielectric substrate.

4. The broadband dipole antenna of claim 1, wherein the width of the feed gap is smaller than 5 mm.

5. The broadband dipole antenna of claim 1, wherein the second radiating part is coupled to a first side of the fifth radiating part through the feed gap, and the third radiating part is coupled to a second side of the fifth radiating part through the feed gap, wherein the first side of the fifth radiating part is opposite to the second side of the fifth radiating part.

* * * * *